US007383884B1

(12) United States Patent
Turner et al.

(10) Patent No.: US 7,383,884 B1
(45) Date of Patent: Jun. 10, 2008

(54) CROSS-OVER TOOL

(75) Inventors: Dewayne M. Turner, Tomball, TX (US); Marvin Bryce Traweek, Houston, TX (US); Stephen C. Yeary, Houston, TX (US); Gregg W. Stout, Mongtomery, TX (US); Christopher L. Blackler, Spring, TX (US)

(73) Assignee: BJ Services Company, Houston, TX (US)

( * ) Notice: Subject to any disclaimer, the term of this patent is extended or adjusted under 35 U.S.C. 154(b) by 118 days.

(21) Appl. No.: 11/123,793

(22) Filed: May 6, 2005

Related U.S. Application Data

(63) Continuation-in-part of application No. 10/614,500, filed on Jul. 7, 2003, now Pat. No. 6,981,551.

(51) Int. Cl.
*E21B 43/02* (2006.01)

(52) U.S. Cl. ..... 166/278; 166/51; 166/334.4

(58) Field of Classification Search ..... 166/278, 166/51, 334.4
See application file for complete search history.

(56) References Cited

U.S. PATENT DOCUMENTS 4,428,428 A 1/1984 Smyrl et al.
5,597,040 A 1/1997 Stout et al.
5,609,204 A 3/1997 Rebardi et al.
5,676,208 A 10/1997 Finley
6,397,949 B1 6/2002 Walker et al.
6,568,471 B1 * 5/2003 Cook et al. ..... 166/177.4
6,634,429 B2 10/2003 Henderson et al.
6,702,020 B2 3/2004 Zachman et al.
6,981,551 B2 * 1/2006 Turner et al. ..... 166/278
2003/0019634 A1 1/2003 Henderson et al.
2003/0192694 A1 10/2003 Zachman

* cited by examiner

*Primary Examiner*—William P Neuder
(74) *Attorney, Agent, or Firm*—Locke Lord Bissell & Liddell LLP

(57) ABSTRACT

A well system comprising an improved cross-over tool is provided. The tool may comprise a debris shield for substantially preventing sand, proppant or other well debris from fouling a flow port closing sleeve located below the cross-over tool fracture ports; a return port cover adapted to close or open a return port upon contact with a designated downhole surface regardless of tubing movement caused by stretching or contracting under stress or other induced pipe movement from downhole conditions; or a collet-type circulation valve adapted to mechanically indicate the position or flow status of the cross-over tool.

30 Claims, 7 Drawing Sheets

CROSS-OVER TOOL

CROSS REFERENCE TO RELATED APPLICATIONS

This application is a continuation-in-part of application Ser. No. 10/614,500, filed on Jul. 7, 2003 now U.S. Pat. No. 6,981,551.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to a subsurface tool used in hydrocarbon wells, and more particularly to an improved cross-over tool.

2. Description of the Related Art

Hydrocarbon wells, such as oil or gas wells, frequently require that the hydrocarbon-bearing formation be fractured to adequately produce hydrocarbons from the well. Fracturing cracks the formation to create more surface area from which the hydrocarbons may flow. Fracturing generally occurs after the well has been drilled, casing has been placed, and various completion tools inserted into the well. Slurry containing fracture propping agents may be pumped into the fractures or cracks to prop the cracks in an open position. A completion assembly having one or more screens may be placed in the well bore to allow hydrocarbons to flow into production tubing and up to the well surface without allowing the proppant, sand and other debris from the formation to flow into the tubing.

Typically, propping agents, i.e., proppants, are pumped through a central flow path, such as a tubing string disposed in the casing, and diverted to an annulus existing between the completion assembly and the casing to fill the annulus in the region of the screen. This flow path may be reversed to wash out to the surface excess proppant and other debris remaining in the system.

Diversion of the flow from the central flow path through the completion assembly and into the annulus is usually effected by a service tool assembly, such as a cross-over tool. Typically, a cross-over tool is positioned in the completion assembly so that the slurry is diverted (or crossed over) from the central flow path of the tubing string into the annulus around the screen and into the formation. The reversal of flow may be accompanied by repositioning the cross-over tool to a reversing position, which creates a flow path down an upper portion of the annulus and back up the central flow path.

In the reversing position, a valve is actuated to close off and seal the fracturing ports in the completion tool assembly. Often times, this valve is a sleeve assembly located below the fracturing ports when the ports are in the opened position. Thus, to close the ports in the completion assembly, the sleeve is typically moved or actuated in an uphole direction. It will be appreciated that when the valve is located below the fracturing ports, debris, such as proppant from the fracturing slurry that doesn't make it to the annulus or sand from the formation, may become lodged about the valve and hamper its operation or effectively prevent its operation. In many cases, reversing the flow will not wash out all of this debris. The remaining debris may cause the completion fracturing port valve to require excessive actuation force or it may cause the valve to be uncloseable.

In this context, this application discloses and claims an improved cross-over tool and method of use.

BRIEF SUMMARY OF THE INVENTION

One aspect of the invention is directed to a method of a treating a well, comprising locating a well tool in a well completion assembly such that a flow port in the tool aligns in fluid communication with a flow port in the completion assembly; providing a return port and a return port cover on the well tool, in which the cover is adapted to restrict flow through the return port at a predetermined time; providing a valve assembly for the completion port so that the completion port has an opened condition in which fluid may flow therethrough and a closed condition in which fluid is prevented from flowing therethrough; contacting a particulate shield with a seat portion of the valve assembly; flowing particulate containing fluid through the tool port and the completion port; whereby the particulate shield substantially prevents particulate matter from adversely affecting operation of the valve assembly.

Another aspect of the invention is directed to a method of a treating a well, comprising: locating a well tool in a well completion assembly such that a flow port in the tool aligns in fluid communication with a flow port in the completion assembly; providing a collet-type circulation valve on the well tool adapted to mechanically indicate at least one flow position of the well tool; providing a valve assembly for the completion port so that the completion port has an opened condition in which fluid may flow therethrough and a closed condition in which fluid is prevented from flowing therethrough; contacting a particulate shield with a seat portion of the valve assembly; flowing particulate containing fluid through the tool port and the completion port; whereby the particulate shield substantially prevents particulate matter from adversely affecting operation of the valve assembly.

Another aspect of the invention is directed to a well treatment system, comprising: a tool assembly having a wall with a flow port formed therethrough to establish a fluid flow path between an interior portion and an exterior portion of the tool, and a return port; a completion assembly having a wall with a flow port formed therethrough to establish a fluid flow path to an exterior portion of the completion assembly, and a closure device for sealing the port to fluid flow; a shield contacting a seat portion of the closure device to substantially prevent particulate matter from adversely affecting closure of the flow port; and a return port cover coupled to the tool wall adjacent the return port and having an at least partially closed position and an at least partially open position.

Another aspect of the invention is directed to a well treatment system, comprising: a tool assembly having a wall with a flow port formed therethrough to establish a fluid flow path between an interior portion and an exterior portion of the tool, and a collet-type circulation valve adapted to mechanically indicate at least one flow position of the tool assembly; a completion assembly having a wall with a flow port formed therethrough to establish a fluid flow path to an exterior portion of the completion assembly, and a closure device for sealing the port to fluid flow; a shield contacting a seat portion of the closure device to substantially prevent particulate matter from adversely affecting closure of the flow port; and a return port cover coupled to the tool wall adjacent the return port and having an at least partially closed position and an at least partially open position.

BRIEF DESCRIPTION OF THE SEVERAL VIEWS OF THE DRAWINGS

FIG. 1 is a schematic cross-sectional side view of a portion of a tool string in an initial "run in" position.

Figure 1:
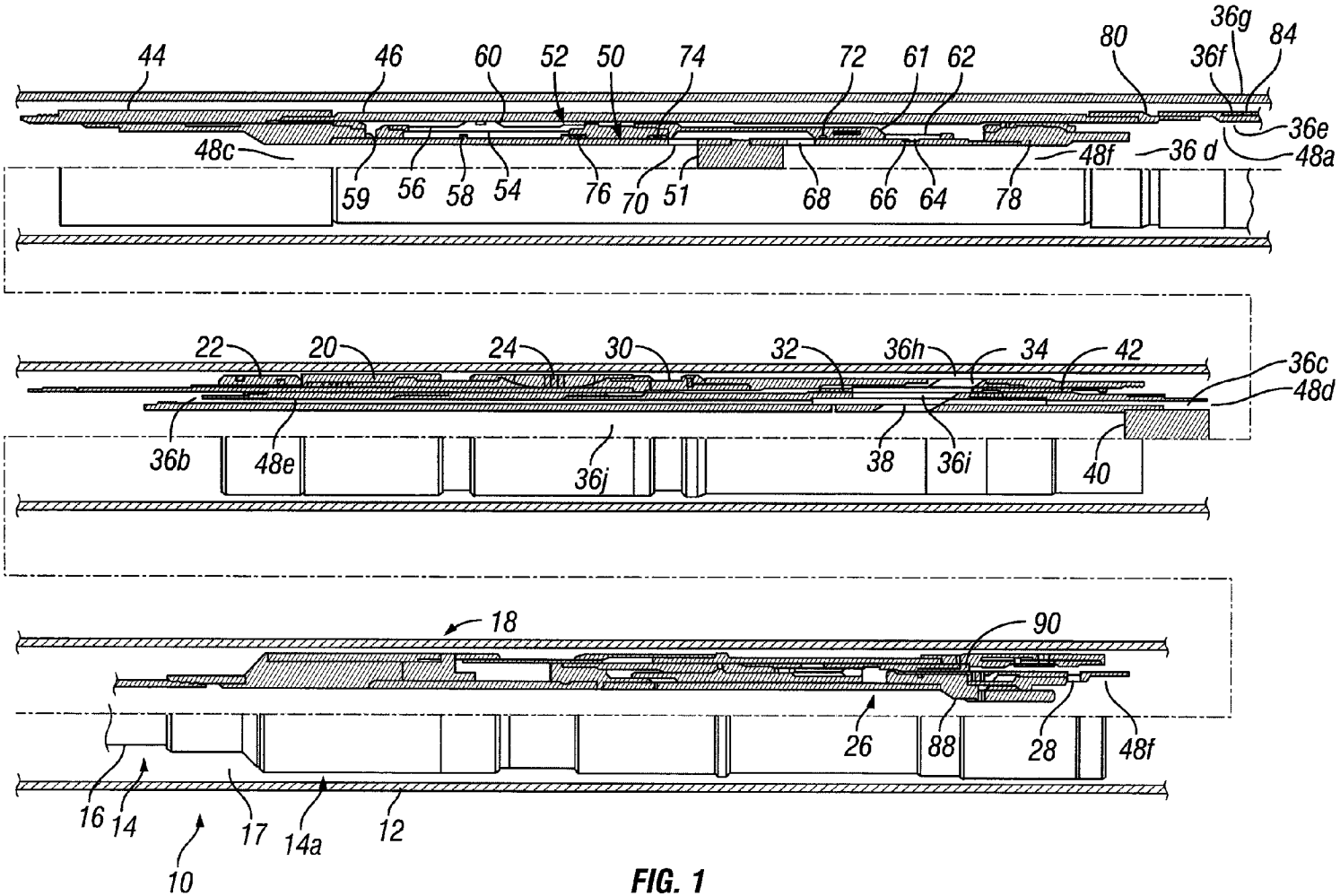
FIG. 1 illustrates

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art as required by 35 U.S.C. § 112.

DETAILED DESCRIPTION

One or more illustrative embodiments incorporating the invention disclosed herein are presented below. Not all features of an actual implementation are described or shown in this application for the sake of clarity. It is understood that the development of an actual embodiment incorporating the present invention, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill the art having benefit of this disclosure.

In general terms, Applicants have created an improved cross-over tool assembly comprising one or more of: a cross-over tool with a return port cover for controlling or restricting fluid loss, a debris shield to protect a fracture port closing valve from contamination and a collet-type circulating valve adapted to mechanically indicate one or more conditions or positions of the cross-over tool.

FIG. 1 is a schematic cross-sectional side view of a portion of a well system 14 in an initial "run in" position. A well bore 10 is established in various strata of the earth, whether on land or sub sea. A casing 12 is generally placed in the well bore, although an uncased well is oftentimes used. A work string may be used is used to carry a series of tools into the well and position the tool string at the correct location. Generally, the work string can include several thousand feet of drill pipe or tubing, depending on the depth of the well bore and location of production zones. The work string establishes a central flow path 15 through the bore of the work string and an annular flow path 17 between the work string and the casing 12. Each flow path is used at various stages of the well treatment process.

Generally, a completion assembly may be used to suspend or locate various downhole tools to form a tool string 14A used to complete the preparation of the well prior to production. Tool string is a general term used to describe a plurality of downhole tools and systems for performing various operations from drilling to completing the well to producing the well. Completion tools can be used to perforate the casing to allow production fluids to flow into the casing, set various packers at appropriate depths, fracture or gravel pack appropriate areas, and other well treatment operations. The completion tools may be removed from the well while other tools, such as a completion assembly, including packers are left in the well bore. A production work string may be set in the well in communication with the completions assembly for production of hydrocarbons to the surface. In some operations, the completion work string and production work string are combined, so that reduced trips into the well bore are possible. For the purposes herein, the term "work string" is meant to at least include any string of pipe, tubing, or wire line used to suspend tools used for completing a well or other well treatments, including pre-production and post-production well treatments.

The system described herein is representative of an assembly that can be used with the present invention, but is not limiting of the invention because the invention can be used with a variety of tool assemblies and well systems. For the purposes of illustration, the well system described below comprises a setting tool 18, a packer 20, a cross-over tool 26, a multi-service sliding sleeve 32, a polished bore receptacle ("PBR") 44, a casing spacer 46, a circulating valve 50, a cross-over reducer 80, and a screen 84. Each of the various tools with their subparts is described below as appropriate.

A setting tool 18 is shown coupled to the work string 14. The term "coupled," "coupling," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include integrally forming one functional member with another. The coupling can occur in any direction, including rotationally. Often, pressurizing the central flow path 15 with fluid hydraulically actuates the setting tool 18, so that various pistons and other devices move to actuate other assemblies.

A packer 20 is selectively coupled to the setting tool 18. The packer can be hydraulically actuated in conjunction with a hydraulic setting tool 18 or movement of the assemblies in the well bore or a combination thereof can mechanically actuate it. A flexible packing element 22 is radially extended to sealingly engage the walls of the casing 12. The extension of the packing element 22 may be controlled with the movement of the setting tool 18 and various subassemblies. One or more slips 24 are used to assist the packer in retaining its placement at an appropriate depth by expanding and gripping the walls of the casing.

Frequently, the packer 20 is set and released from the setting tool 18 and left in the well bore. The packer can be coupled to other tools and systems described herein, which become fixedly positioned when the packer is set. This collection of tools and systems is sometimes referred to a completion assembly. Still other tools can be moved longitudinally or rotationally relative to the fixedly positioned tools, such as when completing the well prior to production. One such tool, a cross-over tool assembly 26, is used to, among other things, change flow paths in the well system. Other well treatment tools having various flow paths can also be used.

The cross-over tool 26 can be coupled to the work string 14 and selectively coupled to the packer 20 through the setting tool 18. The cross-over tool 26 can form a significant piece of the tool string when changes are needed in the flow paths to perform various operations in the well. The cross-over tool 26 includes several subsections and openings in one or more walls of the cross-over tool 26 that move relative to each other to control the various flow paths, described below.

One such subsection and opening includes a return port 28 formed in a wall of the cross-over tool 26 and a cross-over tool return port cover 90 disposed adjacent and proximal to the return port 28. The return port 28 is useful for returning flow to the surface between an interior portion and an exterior portion of the cross-over tool and can also provide pressure monitoring during fracturing or other well treatment processes. Tubing movement, such as that caused by elongation from temperature, load (e.g., pressure stretching) or a combination may allow the return port and other flow paths to be unintentionally opened or closed. This unintended opening or closing can damage the placement of proppant in the fracturing process, such as "fluffing," and cause other challenges.

A solution provided by one aspect of the present invention is to use and provide a return port cover 90 that is unaffected by elongation or pressure. In a preferred embodiment, the return port cover 90 opens on engagement or contact with a known surface and closes at other times. Even though the relative positions of the contacting surfaces can unintentionally move by tubing movement described above, the return port cover can be actuated independently of the tubing movement, so that the return port cover engages and disengages the engagement surface at wherever the engagement surface has been displaced. Thus, the opening and closing of the return port 28 can be controlled. The tubing movement has little ultimate effect on the ability to open and close the port 28, because the return port cover 90 in a broad sense does not depend on a constant positioning with other tools for proper operation. Further details of the return port cover 90 are provided in FIGS. 2 and 3.

The crossover tool 26 also includes a fracturing port 38, through which proppant and other fluids can flow when aligned with other openings. The tool string 14A can move the crossover tool 26 longitudinally and/or rotationally relative to other tools and openings to create the changes in flow paths. Seals above and below the fracture port 38 assist in directing flow to the window 34 in the completion assembly.

A central path sealing surface 40 is used to seal the central flow path 15, often in cooperation with a dropped ball or other movable object, so that flow is directed through the upstream fracture port 38 and fracture window 34. Frequently, the central flow path 15 is pressurized by using the passageway sealing surface 40 at selected times to cause various tooling assemblies to shift or move as described herein.

A circulating valve 50 may be coupled to the crossover tool 26. The circulating valve 50 is sometimes referred to as a "shifting tool" valve because it can be used to move other tools to shifted positions. The circulating valve may also be used to replace the traditional reversing ball in the crossover tool. The circulating valve advantageously allows the monitoring of pressure on the annulus while fracturing the well, in contrast to the reversing ball. However, in some embodiments, where the monitoring is secondary, the reversing ball can be used.

The circulating valve 50 includes a central flow path sealing surface 51 to restrict flow in the central flow path 15 for the various shifting operations using the circulating valve, as is known to those with ordinary skill in the art. The circulating valve 50 preferably comprises a collet assembly 52 having a collet head 54 and a detent collet 61. The collet head 54 includes at least one collet finger 56 that is generally biased radially outward to engage other tools as it is moved longitudinally in the well, e.g, within the completion assembly. The movement of the collet finger 56 is limited between a stroke tab 58 and a corresponding shoulder 59. The collet finger 56 can also include a shifting tab 60 to assist in engaging and shifting other tools as the collet assembly 52 is moved longitudinally. The detent collet 61 can also include at least one collet finger 62 with a detent tab 64. The collet finger 64 may be biased inwardly to engage a detent 66 formed in the circulating valve means 50 to assist in maintaining a shifted position of the collet assembly 52.

As can be seen from the figures, because various tabs and shoulders limit the movement of the collet finger 56, the collet-type circulating valve is able to provide mechanical indication of the flow position of the crossover tool 26. For example, the collet-type circulating valve of the preferred embodiment may indicate that the packer is in the squeeze position by providing a mechanical load indication at the surface, such as a 12,000 to 15,000-lbf resistance. All positions of the crossover tool, e.g., run-in, circulating, squeeze, reversing, may be mechanically indicated by pulling against the various tabs and shoulders in the preferred circulation valve 50.

Figure 5:
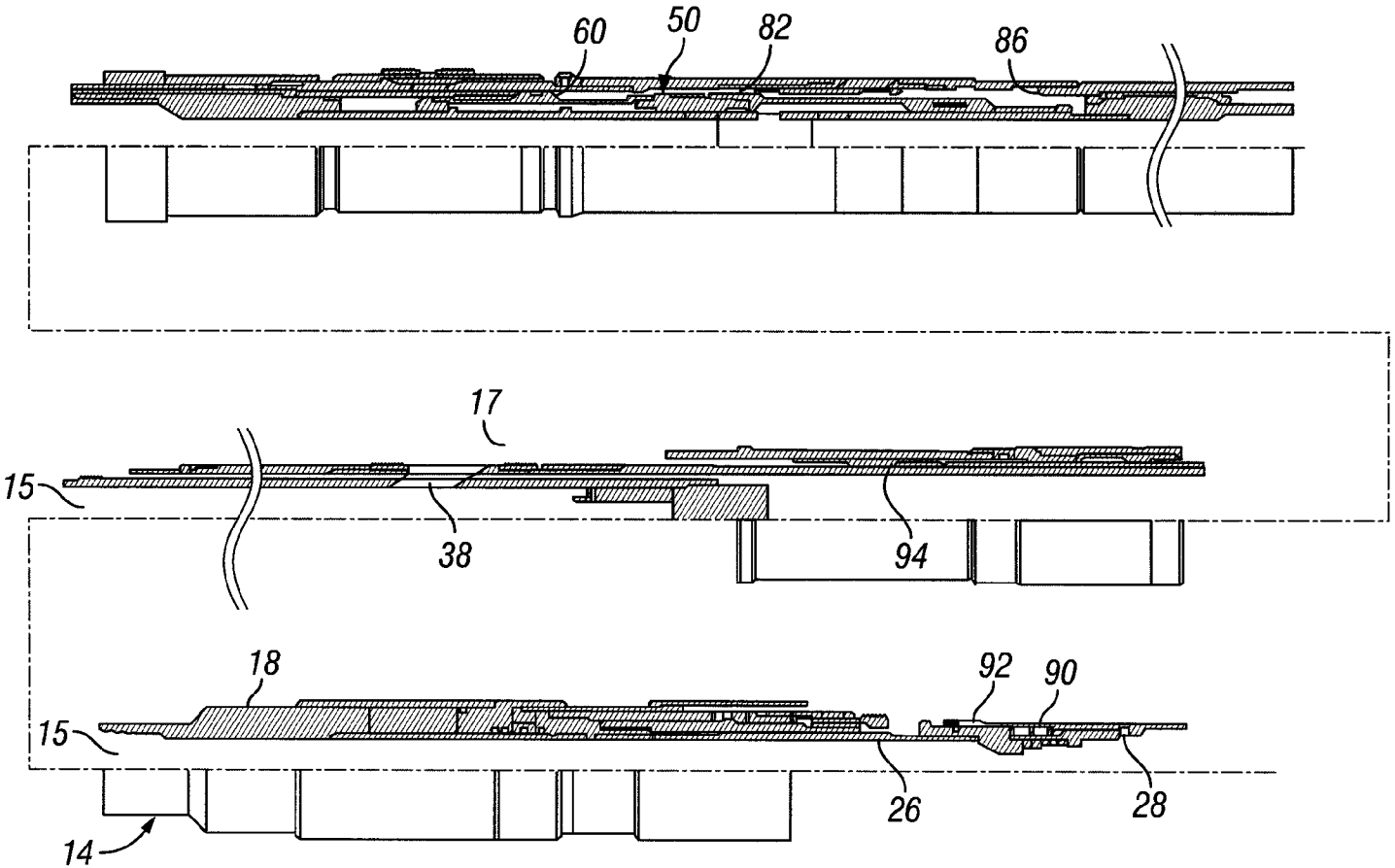
FIG. 5 is a schematic cross-sectional side view of a portion of a tool string in a "reverse" position.

In some embodiments, the circulating valve 50 can also include at least two circulation ports 68, 70 for flowing fluids through the valve around the central flow path sealing surface 51. The ports can be selectively opened and closed by location of the collet assembly 52. The collet assembly 52 can include circulation seals 72, 74, 76 to assist in restricting the flow through the ports 68, 70. The circulation seal 74 can be selectively disposed between the ports 68, 70, as shown in FIG. 5, so that any flow is restricted therethrough and flow is restricted outside of the collet assembly by the two circulation seals 72, 76 to the sides of the circulation seal 74, respectively.

A sealing member 78 having at least one seal can be coupled to the circulating valve means 50. The sealing member 78 is used to selectively engage various portions of the tools, such as the PBR 44, as selected times in the operations to control flow below or above the sealing member 78.

The well system can further include a closure device assembly 32 coupled to the packer 20 through a casing spacer 30. A casing spacer can be of variable length depending on the needs of the particular assembly of tools and well. The closure device assembly 32 is generally mounted external to the cross-over tool 26. The device assembly 32 may used to isolate the formation after the flow of proppant slurry through window 34. As shown in FIG. 1, the window 34 can be, but is not required to be, initially aligned with the fracture port 38 in the crossover tool as a "run in" position.

In the preferred embodiment, the closure device assembly 32 is a sliding sleeve assembly, such as a multi service or "MS" sliding sleeve. The assembly 32 generally includes a window 34 that communicates with other openings, such as the fracture port 38 in the crossover tool 26, for flow therethrough. Seals to either side of the window 34 assist in restricting undesired flow.

A sliding sleeve 42 is usually provided in the closure device assembly 32 to close fracture window 34 and restrict flow from other ports even when the fracture port 38 of the cross-over tool is not aligned with the window, such as may occur during reversing. Oftentimes, the sliding sleeve 42 of the closure device assembly 32 functions in conjunction with the collet assembly 52, described above.

The PBR 44 can be coupled to the closure device assembly 32. The PBR 44 has an internal smooth bore that is used as a sealing surface for various portions of the cross-over tool and other tools with seals as the tools move longitudinally in the well. The PBR 44 provides a sealing surface to restrict unintended flow at portions of the well process, such as in conjunction with the cross-over tool 26 that is moved internally thereto.

A casing spacer 46 can be coupled to the PBR 44 to allow for appropriate spacing between components. The length and use is known to those with ordinary skill in the art and depends on the relative length of the particular tools in the work string and other known factors.

A cross-over reducer 80 can be coupled to the casing spacer 46 to reduce the diameter of the completion assembly and serve as a coupler to a screen 84. The screen 84 can be coupled to the completion assembly below the cross-over tool 28. The screen allows production fluids from the formation into the central flow path 15 while restraining the entrance of the proppant and particles from strata, once the cross-over tool is moved and production tubing and seal assembly is positioned for well production. Other assemblies not shown include a lower packer also known as a "sump packer" for restricting fluid flow past the packer.

Having described the general assembly and various portions in the well system 14, further attention is directed to the return port cover 90.

Figure 2:
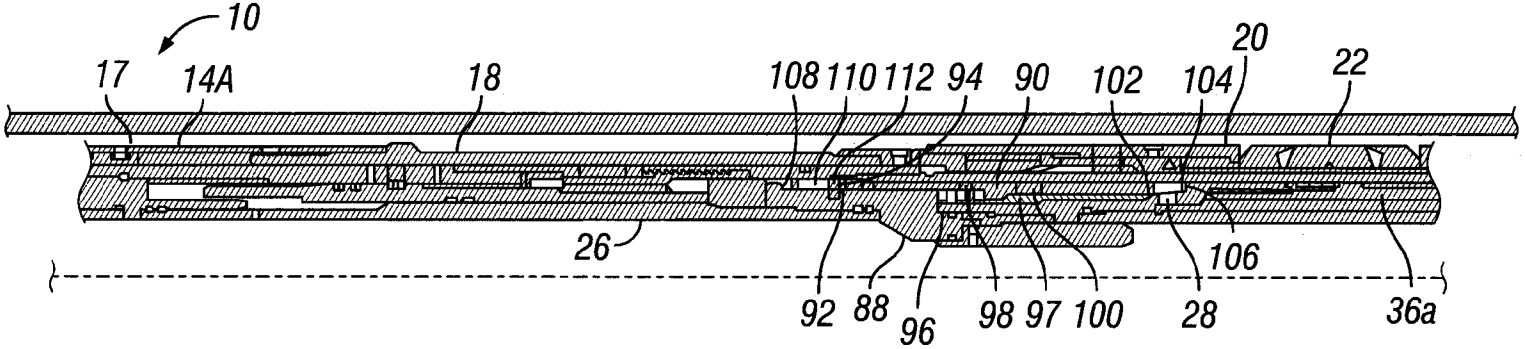
FIG. 2 is a schematic cross-sectional side view of a return port cover in an at least partially opened position on a return port and associated elements.
Figure 3:
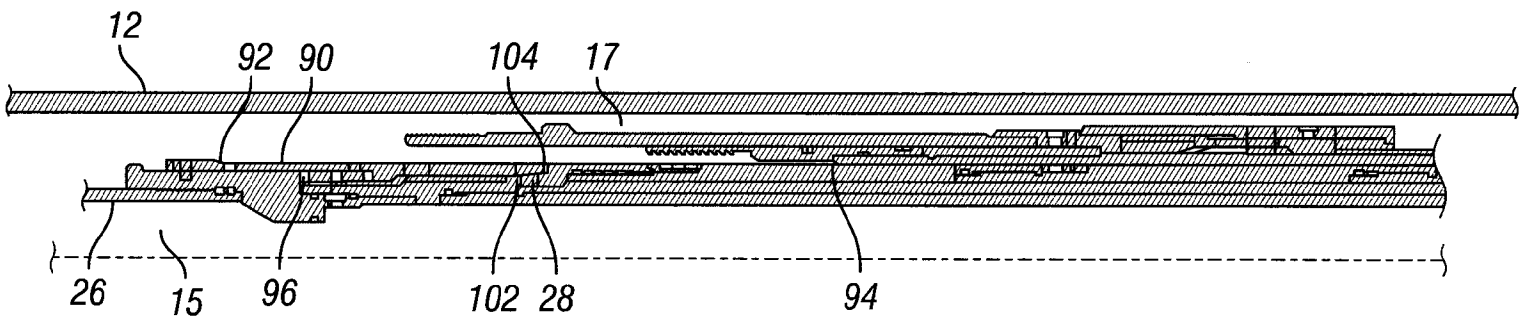
FIG. 3 is a schematic cross-sectional side view a return port cover in an at least partially closed position on the return port and associated elements.

FIGS. 2 and 3 are schematic cross sectional views of details of the return port 28, the return port cover 90, and surrounding elements. FIG. 2 is a schematic cross-sectional side view of a return port cover 90 in an at least partially opened position on a return port 28. FIG. 3 is a schematic cross-sectional side view a return port cover 90 in an at least partially closed position on the return port 28. FIGS. 2 and 3 will be described in conjunction with each other. In general, the work string 14 with a central flow path 15 can be coupled to a setting tool 18, as described above. The setting tool can be coupled to a packer 20 having a packing element 22. A cross-over tool 26 can be releasably coupled to the packer 20, generally near to the top of the packer. The cross-over tool 26 includes a return port 28 for fluid flow therethrough. The return port 28 can be formed as a return port subsection 88 of the cross-over tool 26.

The return port cover 90 is generally mounted external relative to the return port 26 so that external surfaces and/or devices can actuate the cover. For example, the return port cover includes an engagement or contact surface 92, such as a shoulder in this embodiment, another protrusion or a recess. Other engagement surfaces on the return port cover could be used. The engagement surface 92 can be sized to interact with an engagement surface 94, such as a shoulder, formed, for example, on the packer 20. The engagement surface 94 is advantageously formed on or otherwise coupled to an uphole portion of the packer 20 to allow the return port cover 90 to be raised and lowered with minimal interference with other tooling in the well bore. Other surfaces could be used on the packer and other downhole members. A bias element 96, such as a spring or a mechanical lock, may be used to bias the return port cover to one or both positions. The bias element 96 can be housed in a recess 97 formed in the return port subsection 88. One or more openings 98, 100 can also be formed in the return port cover that can assist in washing out debris.

On the portion of the cover that engages the return port, the cover can be formed with a return port cover taper 102. The taper 102 can engage a corresponding taper 104 formed on the return port area. Thus, as the return port cover 90 covers the return port 28, the tapers 102 and 104 matingly engage to restrict flow though the return port. Engagement of the taper enhances the sealing ability of the surfaces, reduces unsealing friction and potential sticking, and limits the travel of the return port cover. In unusual circumstances, a stop 106 formed on the return port subsection can be used to stop the return port cover if the tapers do not engage prior thereto. Similarly, a shoulder 108 formed on the other end of the return port subsection limits the reverse travel of the return port cover 90. Further, seals could be used as necessary or desired, although it is not necessary that the return port cover actually seal the return port. A restriction in flow is usually all that is needed.

A slot 110 is formed in the return port cover 90 to facilitate removal of debris. The slot 110 can work in conjunction with a travel stop 112, such as a setscrew, bolt, pin, or other device mounted within the slot 110.

The return port cover 90 functions with the engagement surface 94 generally when one or more of the fracture packing procedures are being performed. The cross-over tool 26 can be positioned, so that when the return port cover 90 is engaged with the engagement surface 94, the return port is uncovered and thereby at least partially opens the return port 28 as shown in FIG. 2. At other times in the procedures, the cross-over tool 26 can be relocated, for example uphole as shown in FIG. 3, so that the return port cover 90 does not engage the engagement surface 94 and the return port cover is allowed to cover and thereby at least partially close the return port 28. In this embodiment, the return port cover 90 is biased closed over the return port 28 when the return port cover is not engaged with the engagement surface 94.

One advantage of using the engagement surface 94 is that it is located in the packer as one of the most upward engagement surfaces, as in FIG. 2. This position generally assures that the port cover is open and flow can occur through port 28 when the tool is in the circulating or fracturing position. An open port 28 allows monitoring of the fracturing pressure in the upper annulus during pumping operations, i.e., mini-fracing or fracing with proppant.

FIG. 3 shows the tool moved to the reversing position. As surface 92 disengages from surface 94, the bias element 96 at least partially closes the return port cover 90 over port 28 to restrict fluid movement. For example, in the embodiment shown, the flow would be restricted inward toward annular spaces or other flow paths 36*a*, 36*b*, 36*c*, 36*d*, and 36*e*, outside the screen 36*f*, through gravel pack 36*g*, back up through flow path 36*h* at the window 34, and into flow paths 36*i* and 36*j*. This flow path is one example of a flow path that can "fluff" the pack, described above. However, the closure of the return port cover 90 with the return port stops or otherwise restricts this flow.

Thus, the cross-over tool 26 can be moved away from the engagement surface 94 in the well bore and not interfere with the operation of the return port cover 90. Further, the return port cover 90 is coupled and controlled in proximity to the return port 28. Thus, tubing stretch caused by pressures or other downhole conditions on the tubing has little, if any, effect on the ability of the return port cover 90 to at least partially close and open the return port 28.

Returning to FIG. 1, the cross-over tool 26 can be "run in" to the well bore in an open position so that the fracture port 38 of the cross-over tool 26 is aligned or communicating with the window 34 of the closure device assembly 32. This alignment allows for subsequent flow through various openings in a "circulating" position to follow the "run in" position. Further, the sliding sleeve 42 is open to allow the window 34 to receive flow from the tool fracture port 38. For simplicity, an initially open position will be described with the understanding that a closed position could be the initial position.

The well system 14 with a tool string 14A coupled thereto is run into the well bore. The packer 20 with the flexible packing element 22 is not "set" in position against the casing wall, so that a clearance is formed between the packing element and the casing 12 through which the packer is longitudinally run. The tool string is placed at an appropriate depth and the packer is set. In one embodiment, the setting tool is pressurized through fluid in the central flow path 15. The pressure actuates various internal elements to force the packing element 22 radially outward in the annulus 17 to engage the casing 12. The completion tools fixedly coupled to the packer 20 are thus also set in position. While the work string with the setting tool 18 and cross-over tool 26 also releases the packer 20 and tools coupled thereto for independent movement, the work string can leave the cross-over tool 26 and various tools in that relative position for the next position, known as a "circulating" or fracture position.

The return port cover 90 is in a retracted or open state by engagement of the engagement surface 92 on the port cover with the engagement surface 94 on the packer 20, described above. Thus, the return port 28 is open to allow flow therethrough.

Further, the collet assembly 52 of the circulation valve is located in a position that restricts flow through the circulation ports 68, 70. The circulation seal 74 is positioned between the ports 68, 70 with the seals 72, 76 located to both sides of the seal 74 and the ports, respectively.

Figure 4:
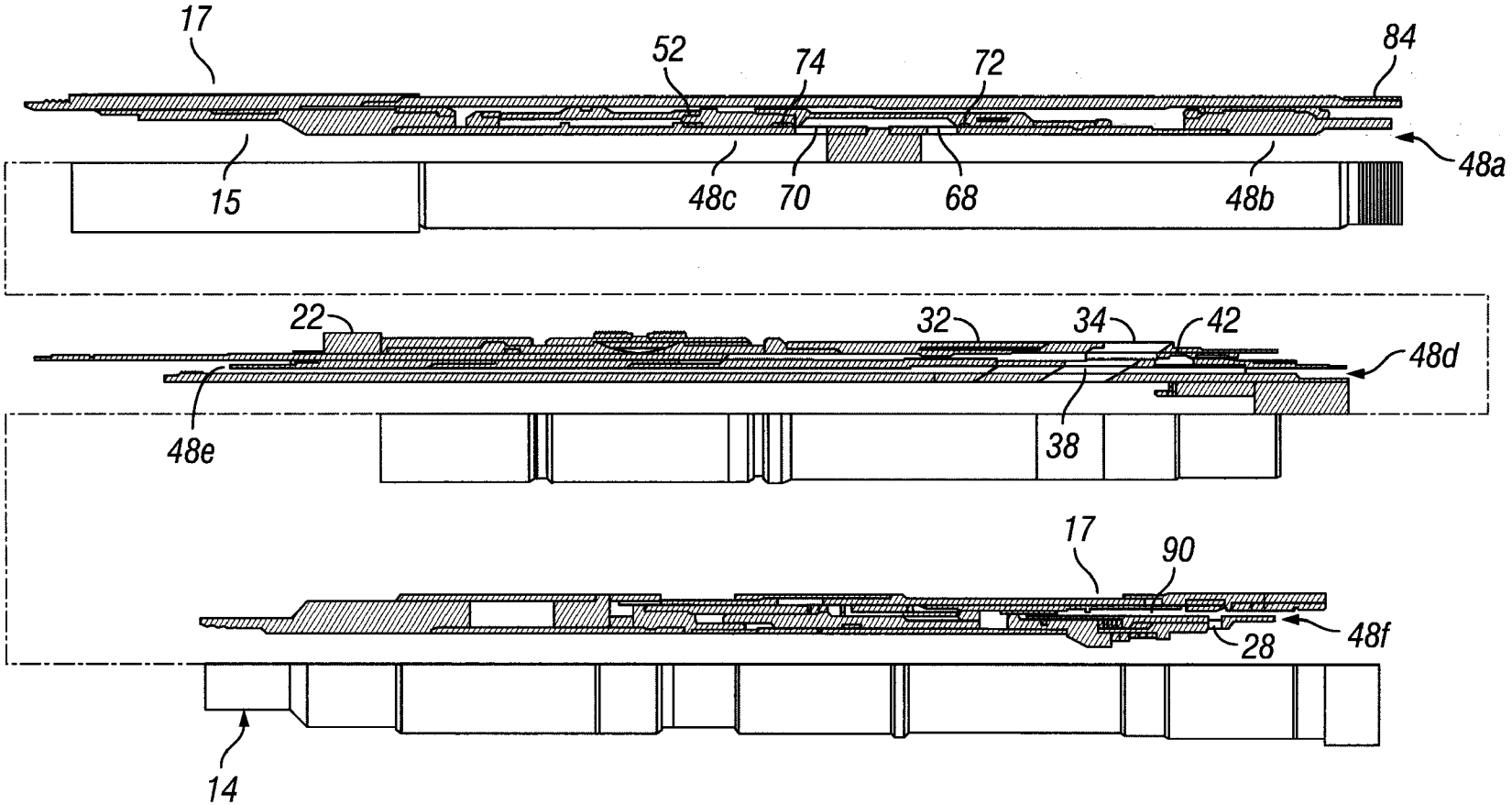
FIG. 4 is a schematic cross-sectional side view of a portion of a tool string in a "circulation" position.

FIG. 4 is a schematic cross-sectional side view of a portion of a tool string in a "circulation" position. The "circulation" position is similar to the "run in" position. However, the collet assembly 52 has been displaced, so that a flow path is created between the circulation ports 68, 70. The circulation seals 72 and 74 can be moved so that circulation seal 72 is on one side of the ports 68, 70 and circulation seal 74 is on the other side of ports 68, 70, allowing flow between the ports, such as from the central flow path 15.

A fluid, such as proppant slurry, can flow through the central flow path 15, through the annulus 17, or a combination thereof. In general, the slurry flows downhole through the central flow path 15, through the cross-over tool fracture port 38 of the cross-over tool 26, through the window 34, into the annulus 17 and down into the area of the screen 84. The slurry flow is restricted from flowing significantly uphole by the presence of the packing element 22 in the annulus 17.

The liquid portion of the slurry passes from the annulus 17 inwardly through the screen 84 to the flow paths 48*a*, 48*b*, through ports 68 and 70, through flow paths 48*c*, 48*d*, 48*e*, 48*f*, port 28, and into annulus 17.

FIG. 5 is a schematic cross-sectional side view of a portion of a tool string in a "reverse" position. The cross-over tool 26 can be raised and lowered in the well bore independently from the packer, once the packer is set and decoupled from the setting tool 18 and cross-over tool 26. In the reverse position, the cross-over tool is pulled away from the packer and the flow reversed in the central flow path 15 and annulus 17.

Importantly, the return port cover 90 becomes disengaged with the engagement surface 94 on the packer 20. In this embodiment, the return port cover is biased closed, so that the cover closes or restricts the return port 28 upon disengagement with the packer. Fluid flows in the annulus 17 through port 38 and up the central flow path 15 to the surface. The reverse flow assists is washing out extraneous materials above the packer and in the central flow path left during the preceding operations. Sufficient tubing movement, caused by the pressure, temperature, buoyancy, and other downhole conditions on the tubing that leads to stretching can cause unintended opening of the circulating valve means 50 by the collet head 54 and tab 60 engaging surfaces 82, 86, or any other surface engaged by downward movement. This unintentional opening is compensated by the location of the return port cover 90 relative to the return port 28. The return port cover 90 can be positioned in the tool string, so that as the work string is raised and lowered, the return port cover 90 remains relatively fixed along the tool string with respect to the port 28. Thus, the return port cover 90 can still open and close the port 28 at the appropriate time, even with tubing movement caused by the extensive length of the work string 14 in the well bore.

Returning to FIG. 4, a sealable sliding sleeve 42 is shown adjacent to fracture window 34. FIG. 4 shows the tool assembly in the circulating position and therefore sliding sleeve 42 is shown in the open condition. In the reversing position shown in FIG. 5, the sliding sleeve 42 is seen in its closed position, which prevents flow through window 34. It will be appreciated that when fluid is communicated through fracture port 38 and through window 34, materials in the fluid, such as proppant in proppant slurry, may fall out of the slurry and be deposited on and around sliding sleeve 42. Such unwanted particles or debris may hamper or prevent the effective closing operation of sliding sleeve 42 necessary for reversing the system. For example, it has been found that debris, such as formation sand, may foul the sliding sleeve 42 and significantly increase the amount of force required to actuate the sliding sleeve 42, which over pull may adversely impact the sliding sleeve 42 and other well system 14 components.

Figure 6A:
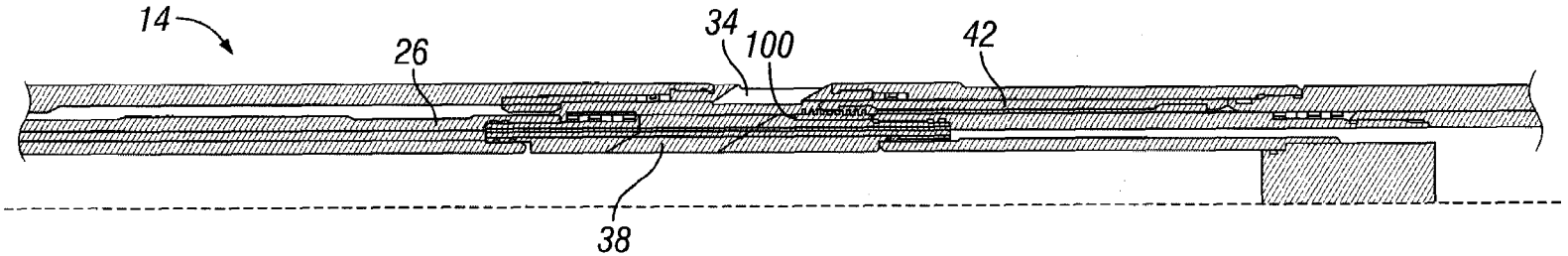
FIGS. 6*a* and 6*b* illustrate a well system having a debris shield according to the present invention.
Figure 6B:
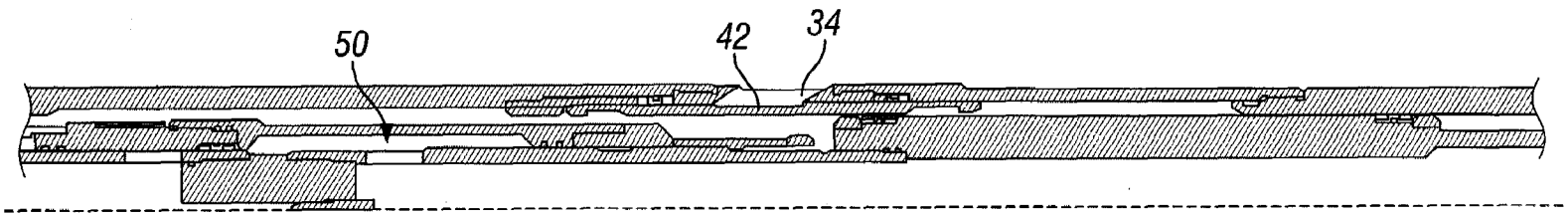

FIG. 6 illustrates a debris shield 100 for use in conjunction with a well system 14 as previously described. FIG. 6A illustrates the tool assembly in the run-in condition, the fracture condition or the squeeze condition in which the window 34 is open and the debris shield 100 effectively prevents debris or other unwanted matter from fouling the closing operation of sliding sleeve 42. FIG. 6B illustrates the tool assembly in a reversing condition in which the sliding sleeve 42 has been actuated so that the fracture window 34 is sealed off from fluid communication.

Figure 7A:
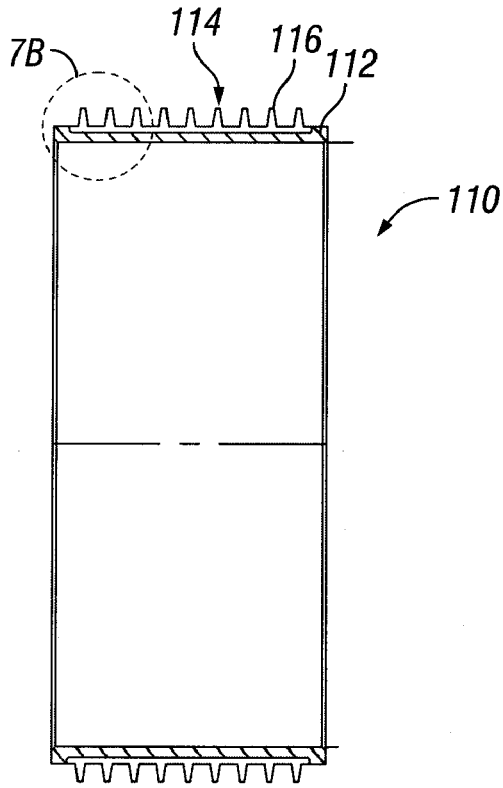
FIG. 7 illustrates a preferred embodiment of a debris shield.
Figure 7B:
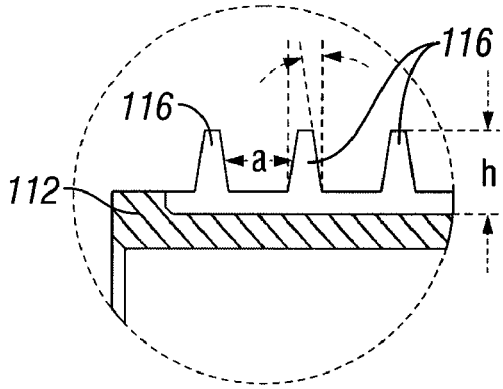

FIGS. 7*a* and 7*b* illustrates a close up, sectional view of the interaction of debris shield 100 and sliding sleeve 42. In the embodiment presently described, debris shield 100 comprises a cylindrical carrier or insert 112, which may be fabricated from material similar to the other downhole tool assembly materials, such as, for example, but not limited to, alloy steel. Bonded to the insert 112 is a seal system 114 having a plurality of sealing ribs 116. The seal system 114 may be manufactured from any number of rubber materials, such as, for example, nitrile, hydrogenated nitrile butadiene rubber (HNBR) or viton. Other sealing materials are known to persons of ordinary skill in the art and may be suitable for the application described herein. Applicants have found that nitrile or HNBR rubber materials with a durometer hardness of 70 or viton with a durometer hardness of 90 work admirably well for this application. As can be seen in FIG. 7*b*, the spacing, a, between each sealing rib 116 is roughly or approximately equal to the height, h, of a single sealing rib 116. This type of rib spacing allows individual ribs to deform and lay over into the space as the debris shield passes through reduced diameter locations in the system 14 during trip in and/or trip out. In the preferred embodiment, the ribs may have sloping walls 118 oriented at an angle of about 10 degrees from an axis normal to a longitudinal axis of the seal system 114.

Figure 8:
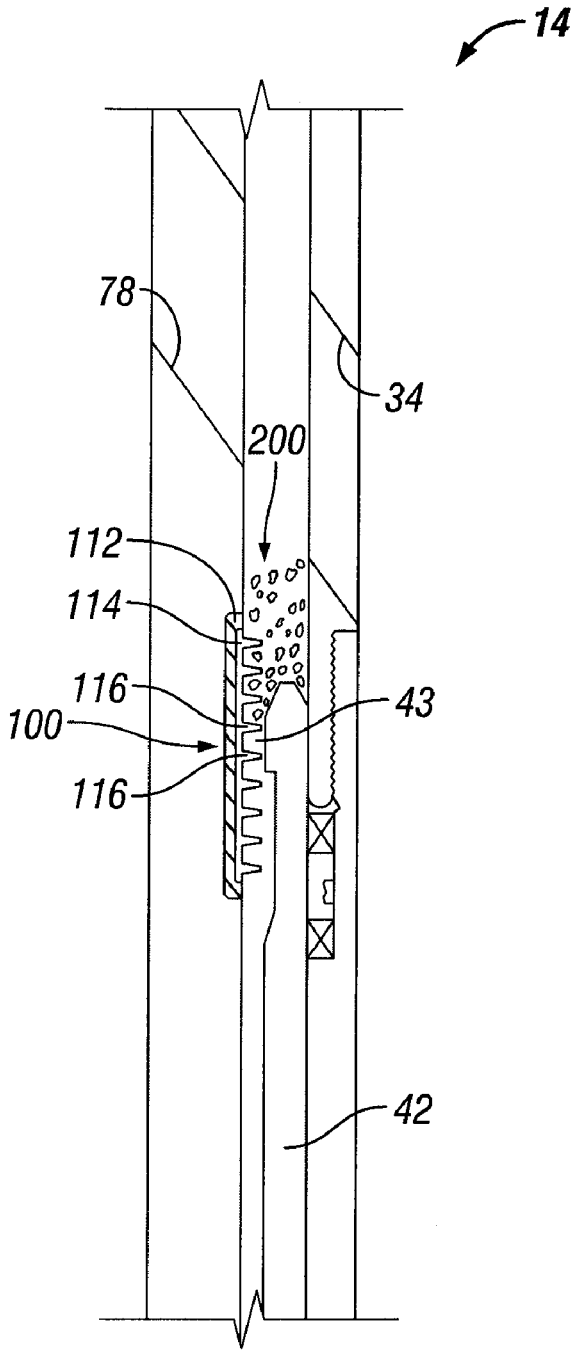
FIG. 8 illustrates the preferred embodiment of FIG. 7 in use with a sliding sleeve valve.

FIG. 8 illustrates the preferred relationship of the debris shield 100 and sliding sleeve 42. As can be seen, and in this preferred embodiment, two sealing ribs 116 are in contact with a sealing surface 43 on sliding sleeve 42. It is preferred that the sealing rib 116 spacing, a, (FIG. 7*b*) not be so great that less than two sealing ribs 116 are in contact with sealing surface 43. Having two sealing ribs 116 in contact with sealing surface 43 provides a measure of redundancy and reliability in keeping debris and other foreign objects out of sliding sleeve 42. FIG. 8 also illustrates unwanted debris 200 stacked up on top of sliding sleeve 42 but not passing by the sealing interface between debris shield 100 and sealing surface 43. The debris shield 100 illustrated and described is not sensitive to fluid flow rate or proppant loading.

While the foregoing is directed to various embodiments of the present invention, other and further embodiments can be devised without departing from the basic scope thereof. For example, the present invention can be used with other well treatment operations beside fracturing, including gravel packing, acidizing, water packing, and other treatments. Further, the various methods and embodiments of the invention can be included in combination with each other to produce variations of the disclosed methods and embodiments. Discussion of singular elements can include plural elements and vice-versa. Further, the use of any numeric quantities herein, particularly regarding the claims, such as "a" or "the", includes at least such quantity and can be more. The use of a term in a singular tense is not limiting of the number of items. Any directions shown or described such as "top," "bottom," "left," "right," "upper," "lower," "down," "up," "side," and other directions and orientations are described herein for clarity in reference to the figures and are not to be limiting of the actual device or system or use of the device or system. The device or system can be used in a number of directions and orientations.

The order of steps can, occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Additionally, any headings herein are for the convenience of the reader and are not intended to limit the scope of the invention.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A method of treating a well, comprising:

locating a well tool in a well completion assembly such that a flow port in the tool aligns in fluid communication with a flow port in the completion assembly;

providing a return port and a return port cover on the well tool, the cover adapted to restrict flow through the return port at a predetermined time;

providing a valve assembly for the completion port so that the completion port has an opened condition in which fluid may flow therethrough and a closed condition in which fluid is prevented from flowing therethrough;

contacting a particulate shield with a portion of the valve assembly;

flowing particulate containing fluid through the tool port and the completion port; and whereby the particulate shield substantially prevents particulate matter from adversely affecting operation of the valve assembly.

2. The method of claim 1, wherein the well tool comprises a cross-over tool.

3. The method of claim 1, wherein the valve assembly comprises a sliding sleeve located below the completion port when the completion port is open.

4. The method of claim 3, further comprising sliding the sleeve upward relative to the completion port to close the port.

5. The method of claim 1, wherein the shield comprises a plurality of sealing ribs.

6. The method of claim 5, wherein at least two sealing ribs contact the seat portion of the valve assembly to substantially seal out particulate debris.

7. The method of claim 5, wherein the sealing ribs are spaced apart one from another a distance that is approximately the height of the ribs.

8. The method of claim 7, further comprising passing the shield through a reduced diameter area in the completion assembly such that the sealing ribs deform into the region between adjacent ribs.

9. A method of treating a well, comprising:

locating a well tool in a well completion assembly such that a flow port in the tool aligns in fluid communication with a flow port in the completion assembly;

providing a collet-type circulation valve on the well tool adapted to mechanically indicate at least one flow position of the well tool;

providing a valve assembly for the completion port so that the completion port has an opened condition in which fluid may flow therethrough and a closed condition in which fluid is prevented from flowing therethrough;

contacting a particulate shield with a seat portion of the valve assembly;

flowing particulate containing fluid through the tool port and the completion port; and whereby the particulate shield substantially prevents particulate matter from adversely affecting operation of the valve assembly.

10. The method of claim 9, wherein the well tool comprises a cross-over tool.

11. The method of claim 9, wherein the valve assembly comprises a sliding sleeve located below the completion port when the completion port is open.

12. The method of claim 11, further comprising sliding the sleeve upward relative to the completion port to close the port.

13. The method of claim 9, wherein the shield comprises a plurality of sealing ribs.

14. The method of claim 13, wherein at least two sealing ribs sealing contact the seat portion of the valve assembly to substantially seal out particulate debris.

15. The method of claim 13, wherein the sealing ribs are spaced apart one from another a distance that is approximately the height of the ribs.

16. The method of claim 15, further comprising passing the shield through a reduced diameter area in the completion assembly such that the sealing ribs deform into the region between adjacent ribs.

17. A well treatment system, comprising:

a tool assembly having a wall with a flow port formed therethrough to establish a fluid flow path between an interior portion and an exterior portion of the tool, and a return port;

a completion assembly having a wall with a flow port formed therethrough to establish a fluid flow path to an exterior portion of the completion assembly, and a closure device for sealing the port to fluid flow;

a shield contacting a seat portion of the closure device to substantially prevent particulate matter from adversely affecting closure of the flow port; and a return port cover coupled to the tool wall adjacent the return port and having an at least partially closed position and an at least partially open position.

18. The system of claim 17, wherein the tool assembly comprises a cross-over tool.

19. The system of claim 17, wherein the closure device comprises a sliding sleeve located below the completion port when the completion port is open.

20. The system of claim 19, further comprising sliding the sleeve upward relative to the completion port to close the port.

21. The system of claim 17, wherein the shield comprises a plurality of sealing ribs.

22. The system of claim 21, wherein at least two sealing ribs sealing contact the seat portion of the closure device to substantially seal out particulate debris from the closure device.

23. The system of claim 21, wherein the sealing ribs are spaced apart one from another a distance that is approximately the height of the ribs.

24. A well treatment system, comprising:

a tool assembly having a wall with a flow port formed therethrough to establish a fluid flow path between an interior portion and an exterior portion of the tool, and a collet-type circulation valve adapted to mechanically indicate at least one flow position of the tool assembly;

a completion assembly having a wall with a flow port formed therethrough to establish a fluid flow path to an exterior portion of the completion assembly, and a closure device for sealing the port to fluid flow;

a shield contacting a seat portion of the closure device to substantially prevent particulate matter from adversely affecting closure of the flow port; and a return port cover coupled to the tool wall adjacent the return port and having an at least partially closed position and an at least partially open position.

25. The system of claim 24, wherein the tool assembly comprises a cross-over tool.

26. The system of claim 24, wherein the closure device comprises a sliding sleeve located below the completion port when the completion port is open.

27. The system of claim 26, further comprising sliding the sleeve upward relative to the completion port to close the port.

28. The system of claim 24, wherein the shield comprises a plurality of sealing ribs.

29. The system of claim 28, wherein at least two sealing ribs sealing contact the seat portion of the closure device to substantially seal out particulate debris from the closure device.

30. The system of claim 28, wherein the sealing ribs are spaced apart one from another a distance that is approximately the height of the ribs.

* * * * *